United States Patent [19]

Wright

[11] Patent Number: 4,903,991

[45] Date of Patent: Feb. 27, 1990

[54] DOCUMENT SECURITY SYSTEM

[75] Inventor: Richard F. Wright, Chillicothe, Ohio

[73] Assignee: The Mead Corporation, Dayton, Ohio

[21] Appl. No.: 514,406

[22] Filed: Jul. 18, 1983

[51] Int. Cl.[4] ..... B42D 15/00

[52] U.S. Cl. ..... 283/95; 283/70; 283/74; 283/77; 283/901

[58] Field of Search ..... 428/916; 430/10, 138; 283/70, 74, 95, 901

[56] References Cited

U.S. PATENT DOCUMENTS

| | | | |
|---|---|---|---|
| 2,953,454 | 9/1960 | Berman . | |
| 3,001,873 | 9/1961 | Foris . | |
| 3,001,887 | 9/1961 | Ahlem, Jr. et al. . | |
| 3,048,697 | 8/1962 | Cavanaugh et al. | 283/58 X |
| 3,072,481 | 1/1963 | Berman et al. . | |
| 3,090,687 | 5/1963 | Berman . | |
| 3,116,148 | 7/1963 | Miller . | |
| 3,219,446 | 11/1965 | Berman . | |
| 3,700,439 | 10/1972 | Phillips . | |
| 3,736,139 | 5/1973 | Yamashita et al. . | |
| 3,892,569 | 7/1975 | Speers . | |
| 3,950,013 | 4/1976 | Tagliaferri | 283/901 X |
| 4,009,892 | 3/1977 | Nickerson | 283/901 X |
| 4,037,007 | 7/1977 | Wood . | |
| 4,149,887 | 4/1979 | Levy . | |
| 4,330,613 | 5/1982 | Fickes | 430/965 X |
| 4,360,548 | 11/1982 | Skees et al. . | |
| 4,397,941 | 8/1983 | Fickes | 430/965 X |
| 4,399,209 | 8/1983 | Sanders . | |
| 4,440,846 | 4/1984 | Sanders et al. | 430/138 |
| 4,562,137 | 12/1985 | Sanders | 430/138 |

FOREIGN PATENT DOCUMENTS

| | | | |
|---|---|---|---|
| 6917733 | 8/1969 | Japan . | |
| 746212 | 2/1974 | Japan . | |
| 7734488 | 8/1977 | Japan . | |
| 789519 | 1/1978 | Japan . | |
| 789520 | 1/1978 | Japan . | |
| 82197538 | 1/1982 | Japan . | |
| 82124343 | 8/1982 | Japan . | |
| 82179836 | 11/1982 | Japan . | |
| 8323024 | 2/1983 | Japan . | |
| 8323025 | 2/1983 | Japan . | |
| 8345084 | 3/1983 | Japan . | |
| 8345090 | 3/1983 | Japan . | |
| 8317432 | 12/1983 | Japan . | |
| 1001831 | 8/1965 | United Kingdom . | |
| 1001832 | 8/1965 | United Kingdom . | |
| 1058798 | 2/1967 | United Kingdom . | |
| 1141475 | 1/1969 | United Kingdom . | |
| 1193923 | 6/1970 | United Kingdom . | |
| 2073661 | 10/1981 | United Kingdom | 283/58 |

OTHER PUBLICATIONS

Research Disclosure, #18747, Nov. 1979, (No. 187?).

"What's Ahead", Lloyd E. Varden, Modern Photography, p. 86, 1958.

*Primary Examiner*—Timothy V. Eley

*Attorney, Agent, or Firm*—Thompson, Hine & Flory

[57] ABSTRACT

A system for verifying the authenticity of documents such as negotiable instruments wherein a field of photoactive microcapsules is provided in a localized area on the document. By image-wise exposing the document, a latent image of a verification meand such as a signature, fingerprint, or the like can be produced on the document which can be instantly developed upon rupturing the microcapsules to verify the authenticity of the document when it is presented.

19 Claims, 1 Drawing Sheet

DOCUMENT SECURITY SYSTEM

BACKGROUND OF THE INVENTION

The present invention relates to a system for verifying the authenticity of documents such as checks wherein a field of photoactive microcapsules containing a radiation sensitive internal phase is provided in a localized area on one or more faces of the document and image-wise exposed to produce a latent image which is developed upon presenting the document and used to verify its authenticity.

Various systems have been developed for authenticating documents but none are particularly convenient for use in authenticating checks and the like which are negotiated by signatures which often cannot be immediately verified. For example, U.S. Pat. No. 3,001,887 to Ahlem, Jr. et al (1961) discloses a system for authenticating documents such as raffle tickets wherein fine colloidal silica is presented on the document in the form of an invisible latent image and the document is authenticated by applying to the surface of the document a colorless reactant such as a color former which reacts with the silica and produces a colored image which can be used to check the validity of the ticket.

U.S. Pat. No. 4,037,007 to Wood (1977) discloses a paper for security documents such as bank checks which contain planchettes which contain one or more color formers wherein the documents are authenticated by the addition of reactants which cause the planchettes to change color.

U.S. Pat. No. 4,360,543 to Skees et al (1982) discloses a method for producing a hidden image by applying to a document surface a colorless ink in the configuration of an image. This ink is overcoated with an encapsulated reactant which is capable of reacting with the ink to form color. The document is authenticated by applying pressure to the encapsulated reactant which causes it to be released from the microcapsules and react with the ink whereupon the hidden image is revealed.

SUMMARY OF THE INVENTION

In accordance with the present invention a field of photoactive microcapsules capable of carrying a latent verification image is provided on at least one surface of a document and the latent image is developed prior to honoring the document by simply rupturing the microcapsules such as by passing the document through a pair of pressure rollers.

In accordance with the invention, the photoactive microcapsules contain a radiation sensitive internal phase which under goes a change in viscosity upon exposure to actinic radiation. This viscosity change controls whether the microcapsules can rupture and release the internal phase when pressure or some other means of rupturing the microcapsules is applied. Typically, the internal phase includes an image forming agent which renders the latent image visible when the microcapsules are ruptured. Thus, documents (including the signatures they carry) can be authenticated by image-wise exposing the field of microcapsules to actinic radiation in the configuration of a verification image such as an authorized signature, an identification number or the like to produce a latent image, and developing this image by rupturing the microcapsules. From the developed image the cashier, teller or the like can determine whether the document or the signatures thereon are authentic.

In the most typical case a subtantially colorless electron donating color former is associated with the microcapsules. The color former reacts with an electron accepting color developer to produce a color image. The color developer may be present in the field of microcapsules (e.g., in an underlying layer), on a separate developer sheet, or less preferably, applied externally following microcapsule rupture. In each case, the color former can only react with the developer in the areas in which the internal phase is released from the microcapsules. Hence, if the microcapsules contain a photohardenable material, by exposing the field to a line image of the authorized signature, the microcapsules in the exposed areas harden and do not release the color former whereas the microcapsules in the unexposed areas corresponding to the signature release the color former which reacts with the developer to produce an image of a signature which should match the signature on the document.

Since documents in accordance with the present invention will be handled in room and/or sunlight prior to developing the latent image, it is important that the radiation sensitive composition in the microcapsules be sensitive to "non-ambient" radiation and be shielded from ambient radiation if it exhibits substantial sensitivity to room or sunlight. This can be accomplished by selecting appropriate photoinitiators and/or incorporating light-shielding agents in the microcapsule wall former. In accordance with a preferred embodiment of the invention, the radiation sensitive composition is only sensitive to intense ultraviolet exposure in the far ultraviolet range (e.g. less than about 360 nm).

The document security system of the present invention is particularly advantageous because the latent image can be applied to the document by photographic techniques without the need to form the latent image mechanically by applying a reactant selectively to the face of the document in the configuration of the latent image as taught in the prior art. As a result, the security system of the present invention can be adapted to apply the verification means at the same time that the documents are cut or drafted. For example, payroll checks provided with a field of microcapsules on the backside could be exposed to provide a latent image of the employee's signature at the same time the checks are completed. Furthermore, in accordance with the preferred embodiments of the invention, the development process is an entirely dry process which can be carried out quickly and easily by cashiers or tellers without the need to apply external developers or processing solutions.

The present invention is not limited to reproducing signatures and identification numbers. Because it relies upon photographic techniques it can also be used to reproduce images of other identification means such as fingerprints or an actual photograph of the person who is entitled to performance upon presentation of the document.

Thus, in accordance with one embodiment of the invention a document is provided having a field of microcapsules on at least one surface thereof in a localized area. The microcapsules contain an internal phase including a radiation sensitive composition which undergoes a change in viscosity upon exposure to actinic radiation and are capable of carrying a latent image in the form of microcapsules which image-wise release the internal phase upon rupturing. A latent image useful in verifying the authenticity of the document or the signatures thereon is produced in the field of microcapsules by image-wise exposing the field to actinic radiation and, in the preferred case, the latent image is developed by rupturing the microcapsules to reveal an image from which the authenticity of the document can be verified.

Another embodiment of the present invention is a process which comprises image-wise exposing the aforesaid field of microcapsules to actinic radiation so as to produce a latent image useful in verifying the authenticity of the document and/or the signatures thereon, and rupturing the microcapsules and developing the latent image to produce a visible image from which the authenticity of the document can be determined.

DEFINITIONS

The term "document" includes negotiable instruments such as checks, travelers cheques, postal orders, lottery tickets, trading checks, bearer bonds and the like as well as documents such a passports, admission tickets, travel tickets and bank notes.

The term "microcapsule" is used herein to refer to both microcapsules having a discrete wall and microcapsules formed in an open phase system wherein discrete droplets of photoactive internal phase are dispersed in a binder. Thus, whenever reference is made to "microcapsules" or "encapsulation" in the specification and appended claims, without reference to a discrete microcapsule wall, both types of microcapsules are intended.

The term "image areas" as used herein means the areas in which the internal phase is released from the microcapsules, regardless of whether the image formed is a positive or negative image.

The term "actinic radiation" is open to the entire electromagnetic spectrum and includes ultraviolet, infrared, visible, X-ray and other radiation sources such as ion beam.

The term "ambient radiation" means radiation which is encountered in substantial intensities in the normal course of daily activity and includes room and sunlight.

DETAILED DESCRIPTION OF THE INVENTION

Figure 1:
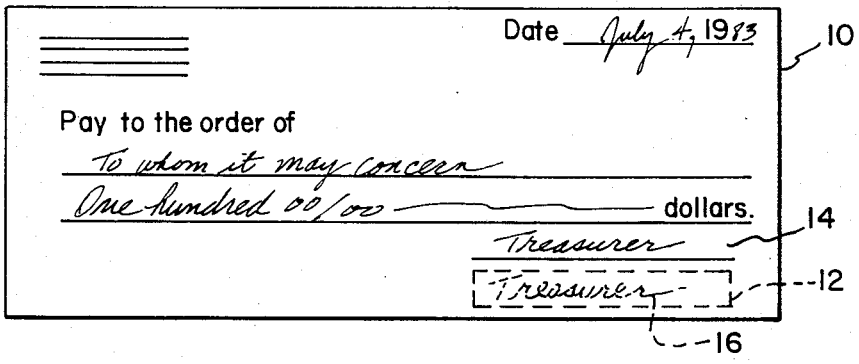
FIG. 1 is an overhead perspective view of the front face of a negotiable instrument in accordance with the present invention.

FIG. 1 illustrates a negotiable instrument 10 in accordance with the present invention having a field of microcapsules 12 on the face thereof below the authorized signature of the drawer 14. The field of microcapsules 12 is shown as containing a latent image of the drawer's signature as indicated by phantom line 16.

Figure 2:
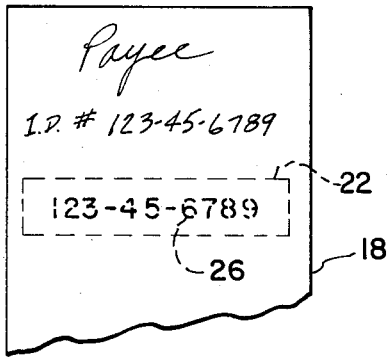
FIG. 2 is an overhead perspective view of the back side of another negotiable instrument in accordance with the present invention.
Figure 3:
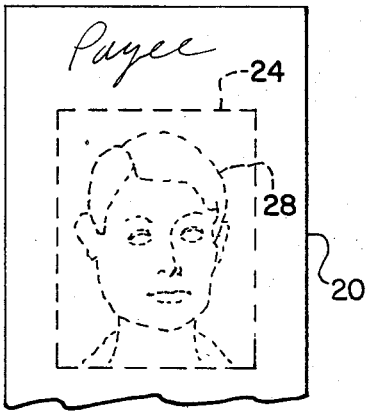
FIG. 3 is an overhead perspective view showing another embodiment of the invention.

FIGS. 2 and 3 illustrate the back side of two instruments 18 and 20 carrying microcapsule fields 22 and 24 respectively. In accordance with the embodiment illustrated in FIG. 2, the microcapsules carry a latent image of an identification number of the authorized payee 26 whereas, in FIG. 3, the field 24 contains an actual image of the authorized payee 28.

The photoactive microcapsules used in the present invention are described in detail in commonly assigned applications Ser. Nos. 320,356 and 320,643 filed Nov. 12, 1981 which are incorporated herein by reference.

Figure 4:
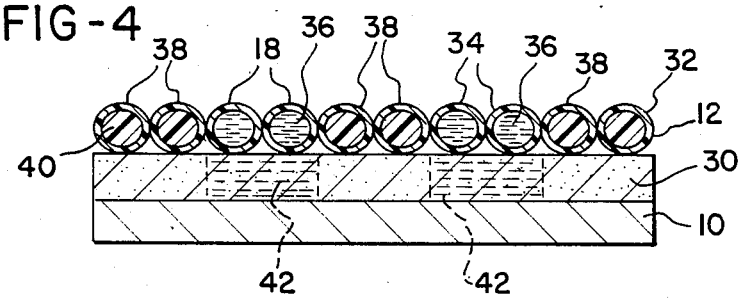
FIG. 4 is a cross-sectional view of a field of microcapsules bearing a latent image in accordance with one embodiment of the present invention.

FIG. 4 is a cross-sectional view through a latent image bearing field of microcapules in accordance with the present invention. Therein the document 10 has on the surface thereof a layer of developer material 30 which is overcoated with a field of microcapsules 12 having discrete microcapsule walls 32. For purposes of this illustration, the microcapsules are considered to contain a photohardenable internal phase which includes a color former and which undergoes an increase in viscosity upon exposure to actinic radiation. Thus, upon exposing the field 12 to an image in the form of an authorized signature, the microcapsules 34 in the areas corresponding to the dark line image of the signature are not exposed and the internal phase 36 remains liquid. In the areas not corresponding to the signature, however, the microcapsules 38 are exposed and the internal phase increases in viscosity. This is shown as actually hardening the internal phase 40 in microcapsules 38, however, in reality the internal phase in the exposed microcapsules may simply be converted to a more viscous, gelatinous or semisolid form. Thus, the field of microcapsules 12 bears a latent image 16 in the form of microcapsules 34 which, following exposure, contain a still liquid internal phase 36.

When pressure is applied to microcapsules 38 in the exposed areas, they do not release the internal phase. In the unexposed area, however, microcapsules 34 rupture and release the internal phase whereupon the color former migrates into the developer layer 30 where a color image (phantom lines) 42 is produced.

Various image-forming agents and radiation sensitive compositions can be used in conjunction with the present invention to produce verification images by a number of different mechanisms. For example, positive working photohardenable or negative working photosoftenable radiation sensitive compositions can be used. Photohardenable compositions such as photopolyermizable and photocrosslinkable materials increase in viscosity or solidify upon exposure and yield positive images. Photosoftenable materials, such as some photodecomposable or photodepolymerizable materials, decrease in viscosity and result in negative images. Either type can be used to produce an image suitable for document verification in accordance with the present invention.

Ethylenically unsaturated organic compounds are useful radiation curable materials. These compounds contain at least one terminal ethene group per molecule. Typically, they are liquid. Polyethylenically unsaturated compounds having two or more terminal ethylene groups per molecule are preferred. An example of this preferred subgroup are ethylenically unsaturated acid esters of polyhydric alcohols, such as ethylene diacrylate, 1,5 pentanediol dimethacrylate, 1,3 propanediol dimethacyrlate, trimethylol propane triacrylate (TMPTA), etc.

Another suitable radiation sensitive composition is an acrylate prepolymer derived from the partial reaction of pentaerythritol with acrylic acid or acrylic acid esters. Photosensitive compositions based on these prepolymers having an acrylate functionality of between approximately two and three are available commercially in two-package systems from The Richardson Company, Melrose Park, Illinois, such as RL-1482 and RL-1483. These are recommended to be mixed together to form a radiation curable clear varnish in a ratio of 4.4 parts of RL-1482 to one part RL-1483.

Another group of substances useful as radiation sensitive compositions include isocyanate modified acrylic, methacrylic and itaconic acid esters of polyhydric alcohols as disclosed in U.S. Pat. Nos. 3,783,151; 3,759,809 and 3,825,479, all to Carlick et al. Radiation curable compositions including these isocyanate modified esters and reactive diluents such as tetraethylene glycol diacrylate as well as photoinitiators such as chlorinated resins, chlorinated paraffins and amine photoinitiation synergists are commercially available as over print varnishes from Sun Chemical Corp., Carlstat, N.J., under the tradename of Sun Cure resins.

The radiation sensitive component of several radiation curable inks is also suitable for use in this invention. An example of this type of material is a mixture of pentaerythritol acrylate and a halogenated aromatic, alicyclic or aliphatic photoinitiator, as disclosed in U.S. Pat. No. 3,661,614 to Bessemir et al.

An example of radiation depolymerizable materials that may be useful in other embodiments of the invention are 3-oximino-2-butanone methacrylate which undergoes main chain scission upon U.V. exposure and poly 4'-alkyl acylophenones. See Reichmanis, E.; *Am. Chem. Soc. Div. Org. Coat. Plast. Chem. Prepr.* 1980. 43, 243–251 and Lukac, I.; Chmela S., Int. Conf. on Modif. Polym. 5th. Bratislave, Czech. July 3–6, 1979, I.U.P-.A.C. Oxford, England 1979, 1, 176–182.

The radiation sensitive composition must make up a large enough proportion of the internal phase to effectively control the flow of the internal phase upon development. This generally means that the radiation sensitive material must constitute approximately 40 to 99% by weight of the internal phase of the microcapsules.

In most cases, the radiation sensitive composition includes a photoinitiator. It is possible to use either photoinitiators which are converted to an active species by homolytic cleavage upon absorption of radiation or those which generate a radical by abstracting a hydrogen from a hydrogen donor. There may also be used photoinitiators which complex with the sensitizer to produce a free radical generating species or photoinitiators which otherwise generate radicals in the presence of a sensitizer. If the system relies upon ionic polymerization, the photoinitiator may be the anion or cation generating type, depending on the nature of the polymerization.

Examples of photoinitiators useful in the present invention include diaryl ketone derivatives, quinones and benzoin alkyl ethers. Where ultraviolet sensitivity is desired, suitable photoinitiators include alkoxy phenyl ketones, O-acylated oximinoketones, polycyclic quinones, phenanthrenequinone, naphthoquine, diisopropylphenanthrenequinone, benzophenones and substituted benzophenones, xanthones, thioxanthones, halogenated compounds such as chlorosulfonyl and chloromethyl polynuclear aromatic compounds, chlorosulfonyl and chloromethyl heterocyclic compounds, chlorosulfonyl and chloromethyl benzophenones and fluorenones, and haloalkanes.

Since the documents in accordance with the present invention are handled in ambient light, it is essential that the radiation sensitive composition within the microcapsules be sensitive to non-ambient radiation and not be sensitive to ambient radiation or that the microcapsule walls sufficiently shield the radiation sensitive composition to prevent its exposure by ambient light. The radiation sensitive composition can be shielded by incorporating ambient radiation absorbers in the microcapsule walls. Preferably, radiation sensitive compositions are used which are sensitive to high intensity ultraviolet radiation preferably in the wavelength range of about 360 nm or less. For ultraviolet sensitivity desirable photoinitiators include Michler's ketone, thioxanthone, and benzophenone. These initiators are sufficiently insensitive to ambient radiation to provide the desired handleability but can be imaged with ultraviolet sources such as a high intensity U.V. lamp or laser.

Various image-forming agents can be used in the present invention. For example, images can be formed by the interaction of color formers and color developers of the type conventionally used in the carbonless paper art. Images can also be formed by the color producing interaction of a chelating agent and a metal salt or by the reaction of certain oxidation-reduction reaction pairs, many of which have been investigated for use in pressure-sensitive carbonless papers. An example of an image-forming salt-chelate pair is nickel nitrate and N,N'bis (2-octanoylox-ethyl)-dithiooxamide. It is preferable to encapsulate the chelating agent and use the salt in a developer layer.

Alternatively, a pigment or an oil soluble dye can be used and images can be formed by transferring the dye or pigment to plain or treated paper to develop the verification image. Substantially any benign colored dye can be used as an image-forming agent. A few examples are Sudan Blue and Rhodamine B dyes. The dyes are preferably oil soluble since the most easily employed encapsulation techniques are conducted using an aqueous continuous phase. The internal phase itself has its own image-forming capability. For example, it is known that the toner used in xerographic recording processes selectively adheres to the image areas of an imaging sheet exposed and developed as in the present invention.

The image-forming agent can be provided inside the microcapsules, in the microcapsule wall, or outside the microcapsules in the same layer as the microcapsules or in a different layer. In the latter cases, the internal phase picks up the image-forming agent (e.g., by dissolution) upon being released from the microcapsules and carries it to the developer layer or an associated developer sheet.

Typical color precursors useful in the aforesaid embodiments include colorless electron donating type compounds. Representative examples of such color formers include substantially colorless compounds having in their partial skeleton a lactone, a lactam, a sultone, a spiropyran, an ester or an amido structure such as triarylmethane compounds, bisphenylmethane compounds, xanthene compounds, fluorans, thiazine compounds, spiropyran compounds and the like. Crystal Violet Lactone and Copikem X, IV and XI are often used alone or in combination as color precursors in the present invention.

Illustrative examples of color developers useful in conjunction with the aforesaid color precursors are clay minerals such as acid clay, active clay, attapulgite, etc.; organic acids such as tannic acid, gallic acid, propyl gallate, etc.; acid polymers such as phenol-formaldehyde resins, phenol acetylene condensation resins, condensates between an organic carboxylic acid having at least one hydroxy group and formaldehyde, etc.; metal salts or aromatic carboxylic acids such as zinc salicylate, tin salicylate, zinc 2-hydroxy naphthoate, zinc 3,5 di-tert butyl salicylate, oil soluble metal salts or phenol-formaldehyde novolak resins (e.g., see U.S. Pat. Nos. 3,672,935; 3,732,120 and 3,737,410) such as zinc modified oil soluble phenol-formaldehyde resin as disclosed in U.S. Pat. No. 3,732,120, zinc carbonate etc. and mixtures thereof.

Preferably, the developer is carried on the document in the field of microcapsules since this simplifies development. If, for example, color precursors are carried in the microcapsules with the radiation sensitive composition, a color developer can be provided in an underlying layer and the visible verification image can be developed by simply rupturing the microcapsules whereupon the color former migrates to the developer layer and reacts. Otherwise, the developer can be provided on a separate sheet in which case the verification image is developed by a transfer process in which the document is assembled with the developer sheet and the microcapsules are ruptured. Other arrangements are also possible. The aforementioned color formers and color developers can be used interchangably, that is the color former can be encapsulated and the developer can be provided in a layer or vice versa.

Depending on the nature of the radiation sensitive composition and whether an image-forming agent is present in the interal phase, a diluent oil may be included in the internal phase. Suitable diluent oils are known in the carbonless paper art and can be used in the present invention as long as they are photographically compatible with the radiation sensitive composition. Alkylated biphenyls, castor oil, mineral oil, and deodorized kerosene are a few examples.

The discrete walled microcapsules used in the present invention can be produced using known encapsulation techniques including coacervation, interfacial polymerization, polymerization of one or more monomers in an oil, etc. Representative examples of suitable wall-formers are gelatin materials (see U.S. Pat. Nos. 2,730,456 and 2,800,457 to Green et al) including gum arabic, polyvinyl alcohol, carboxy-methyl-cellulose; resorcinol-formaldehyde wall formers (see U.S. Pat. No. 3,755,190 to Hart et al); isocyanate wall-formers (see U.S. Pat. No. 3,914,511 to Vassiliades); isocyanate-polyol wall-formers (see U.S. Pat. No. 3,796,669 to Kirintani et al); urea formaldehyde wall-formers, particularly urea-resorcinol-formaldehyde in which oleophilicity is enhanced by the addition of resorcinol (see U.S. Pat. Nos. 4,001,140; 4,087,376 and 4,089,802 to Foris et al); and melamine-formaldehyde resin and hydroxypropyl cellulose (see commonly assigned U.S. Pat. No. 4,025,455 to Shackle).

The material used to form the microcapsule walls must be selected for the radiation sensitive composition that is to be encapsulated such that it is substantially transparent to the exposure radiation. For the systems described above, urea-resorcinol-formaldehyde and gelatin microcapsules are generally preferred.

The mean microcapsule size used in the present invention generally ranges from about 1 to 25 microns.

An open phase system may be used instead of discrete microcapsules. This can be done by dispersing what would otherwise be the internal phase throughout a binder as discrete droplets and coating the composition on the substrate. Suitable coatings for this embodiment include polymer binders whose viscosity has been adjusted to match the dispersion required in the coating. Suitable binders are gelatin, polyvinyl alcohol, polyacrylamide, and acrylic lattices.

Documents embodying the invention can be exposed using a fairly simple exposure apparatus to produce a latent image in the microcapsule field. In its simplest form for reflection imaging, the apparatus requires only a radiation source and means of focusing the exposure radiation from the original onto the imaging sheet. Transmission imaging could also be used. Depending upon the exposure source used and the nature of the exposing radiation, the exposure alone may cause a sufficient change in the viscosity of the internal phase to control imaging. Otherwise, exposure can be used to initiate or advance the photochemistry in the exposed areas and a subsequent uniform exposure or heat treatment can be used to enhance the image.

The latent image can be developed using various means for rupturing the microcapsules, but the application of pressure, generally using pressure rollers, is preferred for its simplicity. In some cases it is possible to rupture the microcapsules by applying a pressure-sensitive adhesive backed sheet to the field and stripping it away.

The present invention is illustrated more specifically by the following non-limiting proposed example.

EXAMPLE

A document may be prepared by coating the following compositions, in order, on a sheet of 80 pound Black and White Enamel Stock (a product of The Mead Corporation) preprinted in a check form or the like:

DEVELOPER COATING COMPOSITION

A mixture of 240 g 25% Tamol 731 (Rohm & Haas Co.), 75 g dry HT clay, 1000 g SD-74 Resin (a synthetic developer manufactured by Fuji Photo Film Co., Ltd.), 15 g Calgon T. (Calgon, Inc.) and 30 g Dequest 20006 (Monsanto Co.) is ground to a particle size of less than 5 microns. 65 parts by weight of the ground mixture is added to 25 parts HT clay and 10 parts Dow 501 Latex (Dow Chemical Co.). This mixture is coated on the aforementioned enamel stock using a No. 10 Meyer rod in a coat weight of 5 pounds per 3300 sq. ft.

MICROCAPSULE COATING

A solution of 50 g TMPTA, 12 g Irgacure 651 (Ciba Giegy), 1 g Quantacure ITX (Blenkinsop & Co., Ltd.) and 6 g of 50% Copikem X in dibutyl succinate (Hilton Davis Co.) is prepared as the photoactive internal phase. This solution is microencapsulated as follows:

A mixture of 22.6 g 20.4% Isobam, 54.5 g water and 30.8 g gum arabic is heated with stirring to 60° C. and the pH is adjusted to 4.0 with the addition of 20% sulfuric acid. Thereafter 8.3 g urea and 0.8 g resorcinol are added and the solution is maintained at 60° C. to prepare a continuous phase. The continuous phase is placed in a Waring blender and the photoactive internal phase at 60° C. is added with blending at 90 V for 90 seconds. Thereafter the speed of the blender is reduced to 40 V and 21.4 ml of 37% formaldehyde is added. Blending is continued at that speed for 2 hours at 60° C. The emulsion is then transferred to a metal beaker and 0.6 g of ammonium sulfate in 12.2 g water is added. This emulsion is stirred with an overhead mixer at 60° C. for another hour and the pH is adjusted to 9.0 using a 10% solution of sodium hydroxide. Finally, 2.8 g sodium bisulfite is dissolved in the mixture with stirring.

The microcapsule preparation is diluted 1:1 with water containing 1% Triton-X 100 (Rohm & Hass Co.) and coated on the developer layer to provide a coat weight of about 6 $g/m^2$.

A document prepared as above can be exposed to low intensity ultraviolet light and handled in room light without deteriorating the latent image.

Having described the invention in detail and with respect to specific embodiments thereof, it will be apparent that numerous variations and modifications are possible without departing from the scope of the following claims:

What is claimed is:

1. A document such as a bill of lading, a check, or the like, said document having markings indicative of a bill of lading, a check, or the like and having a field of microcapsules on at least one surface thereof in a localized area, said microcapsules containing an internal phase including a radiation sensitive composition which undergoes a change in viscosity upon exposure to actinic radiation, said field carrying a latent image in the form of an image-wise distribution of microcapsules which are capable of releasing said internal phase upon rupturing, wherein said latent image is suitable for verifying the authenticity of said document or the signatures thereon, said latent image being produced in said field of microcapsules by image-wise exposing said field to actinic radiation and the authencity of said document being verifiable by rupturing said microcapsules and developing said latent image.

2. The documents of claim 1, wherein said microcapsules have discrete microcapsule walls.

3. The document of claim 2 wherein said microcapsules have associated therewith an image-forming agent which is image-wise mobilized by said internal phase upon rupturing said microcapsules.

4. The document of claim 3 wherein said image forming agent is a substantially colorless color former of the electron donating type which reacts with a color developer of the electron accepting type to produce a color image.

5. The documents of claim 4 wherein said color developer is present on said document in said localized area with said microcapsules.

6. The document of claim 5 wherein said radiation sensitive composition includes a polyethylenically unsaturated compound and a photoinitiator.

7. The document of claim 4 wherein said latent image is an image of an identification number, a signature, or a likeness of a person authorized to negotiate said document.

8. The document of claim 4 wherein said color developer is provided on a developer sheet and said latent image is developed by image-wise transferring said color former to said developer sheet.

9. The document of claim 3 wherein said latent image is developed by rupturing said microcapsules and applying a toner to said field, said toner being one which selectively adheres to said field in the areas in which said internal phase is released.

10. The document of claim 3 wherein said image-forming agent is a visible dye and said latent image is developed by rupturing said microcapsules in contact with a sheet to which said dye is image-wise transferred.

11. The document of claim 1 wherein said radiation sensitive composition is sensitive to non-ambient radiation.

12. A process for verifying the authenticity of a document wherein said document has markings thereon indicative of a check, bill of lading or the like and carries a field of microcapsules on at least one face thereof in a localized area, said microcapsules containing an internal phase including a radiation sensitive composition which undergoes a change in viscosity upon exposure to actinic radiation, said process comprising:

image-wise exposing said field of microcapsules to actinic radiation so as to produce a latent image in said field which is useful in verifying the authenticity of said document, said latent image being an image-wise distribution of microcapsules capable of releasing said internal phase upon their rupture, rupturing said microcapsules and developing said latent image so as to produce a visible image from which the authenticity of said document can be verified, and verifying the authenticity of said document.

13. The process of claim 12 wherein an image-forming agent is associated with said field of microcapsules which is image-wise mobilized by said internal phase when said microcapsules are ruptured.

14. The process of claim 13 wherein said image-forming agent is a substantially colorless color precursor of the electron donating type which reacts with a color developer of the electron accepting type to form a color image.

15. The process of claim 14 wherein said color developer is present on said document in said field with said microcapsules.

16. The process of claim 15 wherein said color developer is present in a layer underlying said layer of microcapsules such that said color developer reacts with said color former in the areas in which said internal phase is released from said microcapsules.

17. The process of claim 14 wherein said color developer is provided on a developer sheet and (said latent image) is developed by contacting said document with said developer sheet in the area of said field and thereby image-wise transferring said color former to said developer sheet and forming an image from which the authenticity of said instrument can be verified.

18. The process of claim 13 wherein said image-forming agent is a visible dye or pigment and (said latent image) is developed by contacting said document in the area of said field with a sheet to which said dye or pigment, mobilized by said internal phase, transfers and forms an image from which the authenticity of said document can be verified.

19. The process of claim 12 wherein (said latent image) is developed by applying a toner to said document in the area of said field, said toner adhering to said field in the areas in which said internal phase is released from said microcapsules.

* * * * *